United States Patent [19]

Hamada et al.

[11] 4,019,087

[45] Apr. 19, 1977

[54] COUPLED-CAVITY TYPE TRAVELING-WAVE TUBE WITH SEVER TERMINATION ATTENUATORS

[75] Inventors: Sadanori Hamada; Kunio Tsutaki; Hiroyuki Hashimoto, all of Tokyo, Japan

[73] Assignee: Nippon Electric Company, Ltd., Tokyo, Japan

[22] Filed: Mar. 16, 1976

[21] Appl. No.: 667,464

[30] Foreign Application Priority Data

Mar. 20, 1975 Japan ..... 50-34692

[52] U.S. Cl. ..... 315/3.5; 315/3.6; 315/39.3

[51] Int. Cl.[2] ..... H01J 25/34

[58] Field of Search ..... 315/3.5, 3.6, 39.3

[56] References Cited

UNITED STATES PATENTS

| | | | |
|---|---|---|---|
| 2,939,993 | 6/1960 | Zublin et al. | 315/3.5 |
| 2,985,791 | 5/1961 | Bates et al. | 315/3.5 |
| 3,024,384 | 3/1962 | Itzkan et al. | 315/3.6 |
| 3,123,736 | 3/1964 | Christoffers | 315/3.6 |
| 3,181,023 | 4/1965 | Hant et al. | 315/3.5 |
| 3,453,491 | 7/1969 | Cerko | 315/3.5 |
| 3,538,377 | 11/1970 | Slocum | 315/3.6 |
| 3,636,402 | 1/1972 | Horigome | 315/3.6 |
| 3,924,152 | 12/1975 | Butwell et al. | 315/3.5 |

*Primary Examiner*—Saxfield Chatmon, Jr.
*Attorney, Agent, or Firm*—Ostrolenk, Faber, Gerb & Soffen

[57] ABSTRACT

A coupled cavity type traveling wave tube is provided with at least one sever termination means comprising a waveguide extending outwardly from one cavity. A ceramic type attenuator is brazed to the interior surface of one thin wall of the extending waveguide. A ceramic type plate is brazed to the exterior side of the same wall whose thickness is selected to permit the thin wall to undergo plastic deformation as a result of thermal deformation of the ceramic members. An enclosure wall is provided to surround at least the ceramic type plate. The enclosure wall is capable of maintaining a vacuum condition even in the case where the thin wall may develop a leak or hole.

Two sever termination means may be provided. The sever termination means may be located on the same side of the coupled cavity type structure or they may be located on the same side and share a common dividing wall, said dividing wall being the aforementioned thin, plastically deformable wall.

6 Claims, 7 Drawing Figures

COUPLED-CAVITY TYPE TRAVELING-WAVE TUBE WITH SEVER TERMINATION ATTENUATORS

BACKGROUND OF THE INVENTION

This invention relates to coupled-cavity type traveling-wave tubes, and more particularly to coupled-cavity type traveling-wave tubes having improved sever attenuators coupled to the slow-wave circuit.

In coupled-cavity type traveling-wave tubes in general, the slow-wave circuit is divided into several sections, and the ends of the divided sections are terminated with the sever attenuators to prevent oscillation from occuring by reflection due to impedance mismatching between the slow-wave circuit and the input or output coupling stage and between the input or output coupling stage and the input or output circuit connected to the input or output coupling stage, thus permitting the tube to maintain stable amplifying operation.

The sever termination attenuators are expected to be capable of terminating the slow-wave circuit with good impedance matching, causing a minimum of gas up due to rise in the temperature of the attenuator body, and maintaining high heat-dissipating efficiency. To meet these requirements, prior art techniques have proposed a method as described in The Bell System Technical Journal, July 1963, pp. 1829–1861, in which the waveguide is led out from the severed end of the slow-wave circuit, and an attenuator structure comprising a ceramic material soaked with an attenuating substance is brazed to the inner wall of the waveguide. This technique, however, is impractible because the attenuator structure is very likely to crack due to heat applied during brazing in the process of making the tube or during the outgassing process or due to a rise in the temperature of the sever attenuators. This arises from the difference in thermal expansion coefficient between the material (e.g., copper) of the wall of the waveguide and the main component material (ceramics) of the attenuator structure. One solution of this problem has been to provide a structural improvement in which the thickness of the waveguide wall is reduced, the attenuator body is brazed thereto on the vacuum side, a ceramic plate for balancing thermal stress on the waveguide wall is brazed thereto on the nonvacuum side, and the thermal stress is absorbed by the thin waveguide wall by utilizing its characteristic of plastic deformation. In practice, however, thinning the waveguide wall to a thickness where the attenuator body and the ceramic plate can be free of stress is very likely to break the waveguide wall due to excess plastic deformation, resulting in a hole or crack in part of the outer wall which maintains a vacuum. This has made it extremely difficult to establish the normal operating reliability of the traveling-wave tube.

BRIEF DESCRIPTION AND OBJECTS OF THE INVENTION

It is therefore an object of the invention to provide a coupled-cavity type traveling-wave tube equipped with an improved sever termination attenuator.

With this and other objects in view, the invention provides improvements in traveling-wave tubes of the type comprising a waveguide and a coupled-cavity slow-wave circuit wherein the waveguide is extended externally from the main body of the slow-wave circuit, and the slow-wave circuit has the sever attenuators with the attenuator bodies constituted of a ceramic containing an electromagnetic energy absorbing substance which is brazed to the inner wall of the waveguide. In particular, the waveguide wall where the attenuator body is brazed is made so thin that the waveguide wall will readily be plastically deformed with the thermal deformation of the ceramic material. A ceramic plate for balancing thermal stress is brazed to the waveguide wall on the side opposite that of the ceramic attenuator body, and the ceramic plate is hermetically covered with an outer structure which maintains the required vacuum. In the sever termination attenuator of the construction set forth hereinabove, the vacuum-tight outer structure can hold the hermetic atmosphere around the thin portion of the waveguide wall even if the thin waveguide wall is broken, permitting the traveling-wave tube to maintain normal operation.

BRIEF DESCRIPTION OF THE FIGURES

Other objects, features and advantages of the invention will become more apparent from the following detailed description when read in conjunction with the accompanying drawings, wherein.

DETAILED DESCRIPTION OF THE INVENTION

Figure 1A:
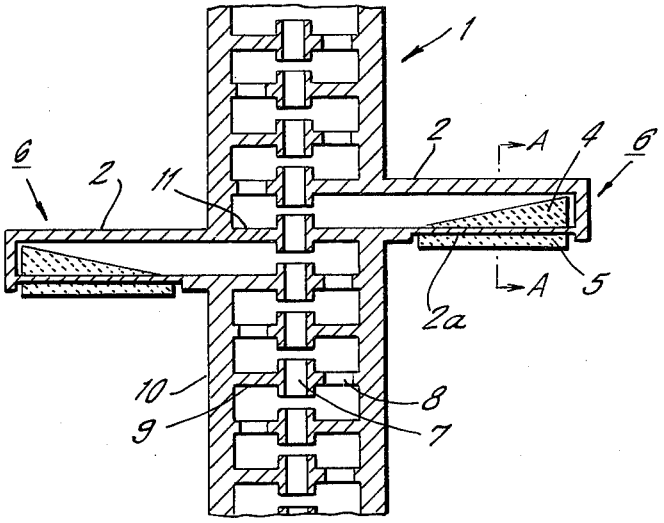
FIG. 1a. (PRIOR ART)
FIG. 1(*a*) is a cross-sectional view showing the essential part of the coupled-cavity type slow-wave circuit comprising the sever termination attenuators of a prior art coupled-cavity type traveling-wave tube, and FIG. 1(*b*) is a cross-sectional view through A—A of FIG. 1(*a*)
Figure 1B:
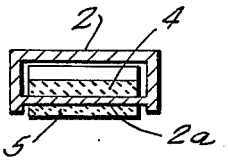
FIG. 1b. (PRIOR ART)

In the prior art traveling-wave tube, as shown in FIG. 1, a waveguide 2 extended from a slow-wave circuit body 1 has a thin wall portion 2*a*, to which an attenuator body 4 is brazed on the vacuum side and a ceramic plate 5 for balancing thermal stress is brazed on the nonvacuum side. In this construction, the thermal expansion is the same on both the inner and outer surfaces of the waveguide wall where the attenuator body 4 and the ceramic plate 5 are brazed, and hence this part of the wall remains unwarped. This is because the attenuator 4 which consists essentially of ceramic material, and the ceramic plate 5 have nearly the same thermal expansion coefficient. Furthermore, the stress exerted on the brazed area due to the difference in the thermal expansion coefficient between the wall 2*a*, the attenuator body 4 and the ceramic plate 5 is readily absorbed by the wall 2*a* due to its plastic deformation, with the result that the attenuator body 4 and the ceramic plate 5 are kept free from the thermal stress and possible cracking. In practice, however, reducing the thickness of the wall 2*a* with the aim to facilitate plastic deformation tends to cause the wall 2*a* to be broken due to excess plastic deformation, leading to a fatal defect — a hole developed in part of the enclosure which maintains a vacuum for the tube. On the other hand, if the wall 2*a* is too thick, the attenuator body 4 and the ceramic plate 5 are liable to crack. If the wall 2*a* is too thin, the wall 2*a* itself is liable to break. Although prior art techniques have proposed various thicknesses to be optimum for the wall 2*a*, no definite approaches have been established to eliminate possibilities of cracking the attenuator body 4 and the ceramic plate 5 or damaging the wall 2*a*.

Figure 2C:
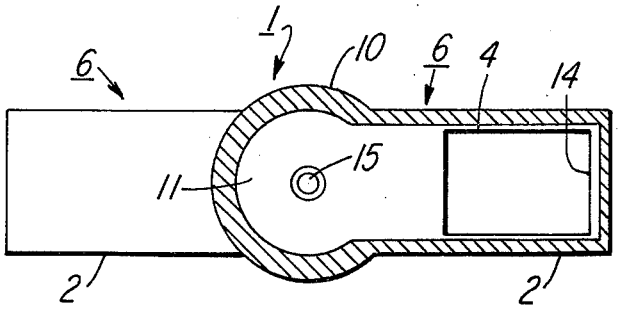
FIG. 2(c) shows a sectional view of the embodiment of FIG. 2(a) looking in the direction of arrows C—C.
Figure 2A:
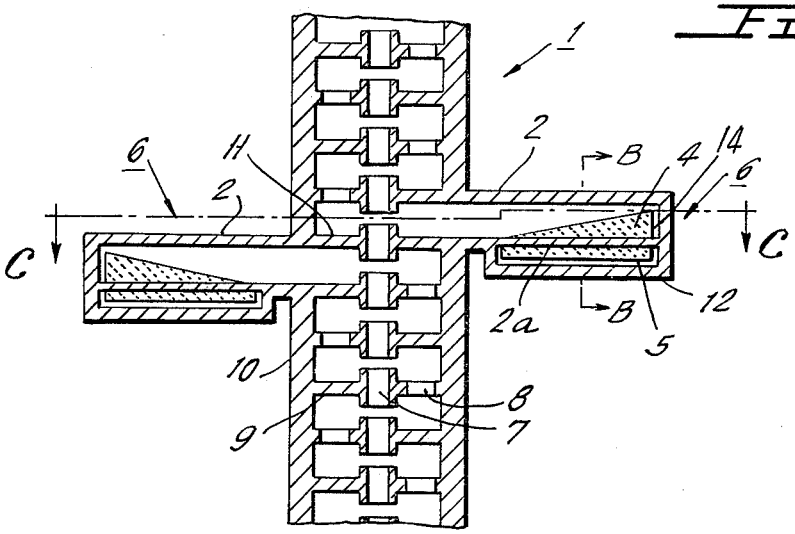
FIG. 2(*a*) is a cross-sectional view showing the essential part of a coupled-cavity type slow-wave circuit of one embodiment of the invention used in a coupled-cavity type traveling-wave tube, and FIG. 2(*b*) is a cross-sectional view through B—B of FIG. 2(*b*), and FIG. 3(*a*) is a cross-sectional view showing the essential part of another embodiment of the invention, and FIG. 3(*b*) is a cross-sectional view through C—C of FIG. 3(*a*).
Figure 2B:
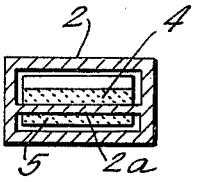

With reference now to FIGS. 2*a* and 2*b*, there are shown cross-sectional views for illustrating an embodiment of the invention, which comprises a sever termination means 6 and a coupled-cavity type slow-wave circuit main body 1 located near the termination means 6. The slow-wave circuit main body is such that a plurality of partitions 9, having electromagnetic field coupling holes 8 and center holes 7 which pass electron beams, are disposed in the waveguide 10. The slow-wave circuit main body 1 is divided into two parts by a partition 11 which has only a center hole 7, and a waveguide 2 extends outwardly from the end of the severed part, which is then terminated at the sever termination means 6 having an attenuator body 4 in the waveguide. The thickness of the waveguide wall is reduced in the area 2*a* where the attenuation body 4 is brazed. A ceramic plate 5 is brazed to the wall 2*a* on the outer side. This thin wall part 2*a* does not serve directly as part of the vacuum-tight enclosure for the tube; the thin wall part 2*a* and the ceramic plate 5 are covered with a metal enclosure 12 which maintains a vacuum. The wall 2*a* must be thin, i.e. of a thickness selected to allow the attenuator body 4 to be free of cracking. Thus, even if the wall 2*a* is broken due to excess plastic deformation, the metal enclosure 12 assures the vacuum of the tube. Preferably the hollow interior region defined by the thin wall 2*a* and the outer thick wall 12, which hollow region is occupied by member 5, is maintained at the same vacuum level as the slow-wave structur, i.e. is maintained at the same vacuum level as the interior of the wave guide 6 housing attenuator body 4. The obvious and most simple way of maintaining equal vacuum levels is the provision of opening 14 provided in interior wall 2*a* to maintain equal vacuum levels.

Figure 3A:
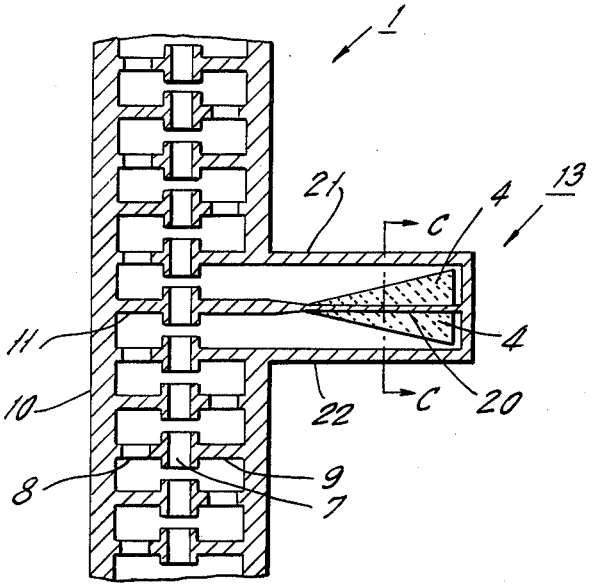
Figure 3B:
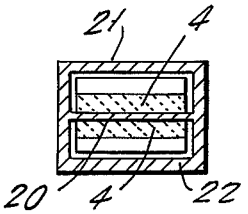

Referring to FIG. 3, cross-sectional views are shown to illustrate another embodiment of the invention, in which the slow-wave circuit main body 1 is divided into two parts by a partition 11 which has a center hole 7 for the passage of electron beams but has no electromagnetic field coupling hole 8 as in the first embodiment. Waveguides 21 and 22 both extend outwardly from the end of the divided portion in parallel and in the same direction, thus forming a sever termination means 13. In particular, the two waveguides 21 and 22 are disposed back to back, with a common partition 20 between them. Two attenuator bodies 4 are brazed to the walls of the waveguides 21 and 22, respectively, on both sides of the partition 20. As is the case with the thin wall part 2*a* in FIG. 2, the wall 20 of the waveguides is made thin in the area where the attenuator bodies 4 are brazed, in order to allow this thin wall part to facilitate its plastic deformation as a result of thermal deformation developed in the attenuator bodies 4. In this construction, as in the first embodiment, the vacuum of the tube is maintained even if the wall 20 is broken due to excess plastic deformation, because the wall 20 does not function to sustain the vacuum.

According to the invention, as has been described above, the vacuum of the tube is assured even if a hole is developed in the thin waveguide wall as a result of damage due to excess plastic deformation, because the sever termination means is of the construction in which the waveguide wall where the attenuator body is brazed does not serve as part of the vacuum-tight outer wall. In other words, the waveguide wall can be made thin enough in the area where the attenuator body is brazed, to permit the attenuator body to be free of cracking. At the same time, possibilities of causing the vacuum of the tube to be ruined due to a break in the thin waveguide wall are eliminated.

What is claimed is:

1. In a traveling-wave tube equipped with a coupled-cavity type slow-wave circuit having a housing for vacuum sealing the slow-wave structure, comprising a vacuum sealed waveguide extending outwardly from said housing and having its interior communicating with the interior of said slow-wave structure housing, sever termination means having an attenuator body which is essentially comprised of a ceramic material containing an electromagnetic energy absorbing substance and is brazed to the inner surface of one wall of said waveguide and which is electromagnetically coupled to the slow-wave circuit element;

said coupled-cavity type traveling-wave tube being characterized in that the waveguide wall where the attenuator body of the sever terminations means is brazed is made sufficiently thin to allow the waveguide wall to be readily plastically deformed as the ceramic material attenuator body is thermally deformed, a ceramic plate for balancing thermal stress is brazed to the outer side of the thin waveguide wall opposite that of the attenuator body, and the ceramic plate is hermetically enclosed within an outer structure joined to said waveguide and enclosing said thin waveguide wall and said ceramic plate which maintains a vacuum condition within its interior.

2. A coupled-cavity type traveling-wave tube as set forth in claim 1, wherein two sever termination means are disposed adjacent each other and being arranged on diametrically opposing sides of the coupled-cavity type slow-wave circuit.

3. The tube of claim 2 wherein the slow-wave structure housing contains a plurality of spaced substantially parallel partitions dividing said housing into a plurality of compartments communicating with one another by means of axially aligned openings in each partition; one of the partitions being common to said two sever termination means.

4. A coupled-cavity type traveling-wave tube as set forth in claim 1 wherein the space inside the waveguide wall where the attenuator body of ceramic material is brazed and the space formed between the vacuum tight outer structure which hermetically covers the thermal stress balancing ceramic plate and the outer wall of the waveguide communicate with each other and are maintained at the same pressure.

5. In the traveling-wave tube equipped with a coupled-cavity type slow-wave circuit having sever termination means wherein a waveguide is extended externally from the slow-wave circuit main body, and an attenuator body comprised essentially of a ceramic material containing a wave-absorbing substance is brazed to the inner wall of the waveguide;

a coupled-cavity type traveling-wave tube characterized in that the waveguide is composed of two waveguides extending outwardly from said main body and being disposed back to back, with a common metal partition between them, a pair of attenuator bodies respectively brazed to opposite sides of a portion of the metal partition, and the portion of the metal partition where the attenuator bodies are brazed being sufficiently thin to allow said thin portion of the metal partition to be plastically deformed as the attenuator bodies are thermally deformed; the thickness of the waveguide walls of the two waveguides surrounding the common partition being sufficient to hermetically seal the vacuumized interiors of the two waveguides without danger of cracking.

6. A coupled-cavity type traveling-wave tube as in claim 5 wherein the coupled-cavity type slow-wave circuit comprises a plurality of coupled-cavity type slow-wave circuits, and a sever termination means is disposed between the individual coupled-cavity type slow-wave circuits.

* * * * *